US006644586B2

(12) United States Patent
Birke et al.

(10) Patent No.: US 6,644,586 B2
(45) Date of Patent: Nov. 11, 2003

(54) WINDING DEVICE

(75) Inventors: Roland Birke, Plauen (DE); Heino Sommer, Bielefeld (DE)

(73) Assignee: KKA Kleinewefers Anlagen GmbH, München (DE)

( * ) Notice: Subject to any disclaimer, the term of this patent is extended or adjusted under 35 U.S.C. 154(b) by 0 days.

(21) Appl. No.: 10/015,907

(22) Filed: Dec. 12, 2001

(65) Prior Publication Data

US 2002/0079401 A1 Jun. 27, 2002

(30) Foreign Application Priority Data

Dec. 21, 2000 (DE) ..... 100 63 823

(51) Int. Cl.[7] ..... B65H 19/26

(52) U.S. Cl. ..... 242/527.4; 242/527.2; 242/527.3; 242/533.4

(58) Field of Search ..... 242/527.2–527.4, 242/533.4–533.6

(56) References Cited

U.S. PATENT DOCUMENTS 4,993,652 A * 2/1991 Moeller ..... 242/527.3
5,251,836 A * 10/1993 Pack ..... 242/527.3
6,264,130 B1 * 7/2001 Hartley, Jr. ..... 242/527.3

FOREIGN PATENT DOCUMENTS

| | | | |
|---|---|---|---|
| DE | 1774876 | 1/1972 | |
| DE | 2823326 | 12/1978 | |
| DE | 4016526 | 7/1991 | |
| DE | 4104082 | 8/1992 | |
| JP | 58139953 A * | 8/1983 | ..... B65H/19/22 |

* cited by examiner

*Primary Examiner*—Kathy Matecki
*Assistant Examiner*—Sang Kim
(74) *Attorney, Agent, or Firm*—Friedrich Kueffner

(57) ABSTRACT

A winding device for winding a material web into a roll includes a roll carrier with at least two driven roll support members which are each movable between a winding position and an exchange position, a transfer device and a contact pressure device. The roll support members can be driven in two different directions of rotation. A first material web path is provided at the end of which the material web travels in a first direction onto the roll and a second material web path is provided at the end of which the material web travels in a second direction onto the roll. The transfer device includes a first cutting device which is movable from a first side into the material web and a second cutting device which is movable from a second side into the material web.

10 Claims, 3 Drawing Sheets

WINDING DEVICE

BACKGROUND OF THE INVENTION

1. Field of the Invention

The invention relates to a winding device for winding a material web into a roll. The winding device includes a roll carrier which includes at least two driven roll support members which are each movable between a winding position and an exchange position. The winding device further includes a transfer device and a contact pressure device.

2. Description of the Related Art

In the following, the invention will be described in connection with winding of foils. This is the principal field of application. However, other material webs can also be wound into rolls in the same manner.

As a rule, material webs must after the end of a manufacturing process be wound into rolls which can be manipulated. Such material web rolls are also sometimes used for the intermediate storage of the material web. However, the capacity of such material web rolls is limited, i.e., an exchange of the roll is required when a predetermined length of the material web has been wound up. Such an exchange of rolls requires an interruption in the feeding of the material web. In that case, there is sufficient time for severing the material web, for securing the end of the finished wound-up roll, and for fastening the beginning to another new roll core. However, this type of procedure is not possible in practice if the material web is supplied continuously. This is the case, for example, in the manufacture of foils which are extruded. In that case, the material web must be severed practically instantly and the beginning of the material web must be secured on a new roll core, so that winding can take place without interruption.

The transfer of the material web from a finished material web roll to a roll core is known in the art. There are several possibilities. In more complicated arrangements, the material web is severed simultaneously over the entire width, so that a cut is formed which extends essentially perpendicularly over the web travel direction. At the same time as the web is severed, the beginning of the material web formed during the performance of the cut is conducted around the new winding sleeve and, possibly after traveling through a nip, is conducted underneath the material web which continues to be supplied, so that the material web holds itself on the roll core. In this case, it is not necessary to prepare the roll core, for example, by rendering it adhesive. In many cases, such a preparation is not even desirable because the object is to save costs. In simple transfer devices, a cutting knife is moved transversely of the material web. Since the material web continues to travel, essentially an oblique cut is produced. The tip created in one side of the material web as a result of the cut can then be utilized for fastening the tip to the new winding sleeve. However, this type of procedure has the result that the material web is not wound up uniformly. Rather, a helically shaped step location may be produced which later may lead to undesirable problems.

An additional difficulty is the fact that some material webs are supposed to be wound in such a way that their upper sides are located on the outer side of the wound-up roll. On the other hand, other material webs have to be wound in such a way that their upper sides face inwardly. The automatic exchange of the winding directions has practically not been possible in the past even with a relatively complicated arrangement. It is not sufficient to simply reverse the drive of the roll because the conditions in which the material web is wound onto the roll are no longer correct.

SUMMARY OF THE INVENTION

Therefore, it is the primary object of the present invention to provide a winding device which can be operated independently of the winding direction with an essentially equally high winding quality.

In accordance with the present invention, a winding device of the above-described type is proposed in which the roll support members can be driven in two different directions of rotation. A first material web path at the end of which the material web travels in a first direction onto the roll and a second material web path at the end of which the material web travels in a second direction onto the roll, are proposed. The transfer device includes a first cutting device which can be moved from a first side into the material web and a second cutting device which can be moved from a second side into the material web.

In the winding device according to the present invention, a change of the winding direction can be achieved in a relatively simple manner. The material web must only be diverted from one material web path to the other material web path. By changing the web travel direction in the winding device, the material web is conducted in such a way that it travels in the correct direction onto the roll. This correct direction is usually practically tangential.

The roll drive can also be combined with an appropriate control which controls the roll drive in dependence on the material web pattern into the correct direction. Alternatively, it may also be provided that a material web path is only released if the roll drive takes place in the correct direction. Finally, two cutting devices are provided which are movable into the material web from two different sides for cutting the material web. This ensures independently of the winding direction that the material web can always be conducted around the new winding sleeve by means of the cutting device, so that the transfer can also take place almost independently of the winding direction with the desired high quality, i.e., practically without wrinkles from the first winding layer. By adjusting operational elements, it is possible at both transfer devices to adapt to different winding sleeve diameters within a relatively wide range.

In accordance with a preferred embodiment, the two cutting devices are constructed in a mirror-symmetrical configuration relative to each other. An exact symmetry is not required. Smaller deviations which may be due to structural causes are readily permissible. If the two cutting devices are arranged essentially in a mirror-symmetrical configuration, then cutting by the two cutting devices takes place in the same manner and the material web is guided in the same manner onto the new winding sleeve independently of which cutting device is active. Consequently, the quality of the first winding layers is the same for both winding directions. It is already ensured at the beginning of the winding process that the rolls are begun practically equally in both winding directions.

Each cutting device preferably has a pressure member on the opposite side of the material web. The pressure members are also constructed and arranged in a mirror-symmetrical configuration relative to each other and are adjustable to different sleeve diameters. Such a pressure member facilitates the cutting of the material web. The pressure member essentially forms a beam at which the material web can be sheared of f by the cutting device. This is also true if the cutting device and the pressure member are not constructed with cutting edges which contact each other, as is the case in a shear. When the pressure member is moved towards the material web, the pressure member prevents the material web from yielding too much and to later produce wrinkles on the winding sleeve and, thus, acts as a counter pressure member. In other words, the pressure member produces a tension in the material web which is sufficient for severing the material web with a sudden cut and to prevent contact wrinkles at the beginning of the winding process.

In accordance with a preferred embodiment, the pressure member of a cutting device is arranged on a carriage which is displaceable relative to a knife unit of the other cutting device. If it is desired to use two cutting devices, there is the problem with respect to the pressure member that only a limited amount of space is available. If the pressure member of one cutting device is displaceable, then it is possible to move this pressure member out of the range of action of the other cutting device if this cutting device is to be operated. Consequently, the necessary space of movement for the cutting device is provided in a simple manner without sacrificing the function of the pressure members for both winding directions.

In accordance with a particularly preferred feature, the pressure member includes a lever arm which is pivotably mounted on the carriage. This provides a larger free space for the displaceability of the carriage. If the carriage is to be moved, the pressure member can be pivoted in such a way that it does not collide with any additional structural components. The movement control becomes relatively simple as a result.

In accordance with another particularly preferred feature, an auxiliary arm is arranged on the lever arm, wherein the auxiliary arm can be pivoted in a controlled manner relative to the lever arm and wherein the auxiliary arm has a cutting edge. Consequently, the auxiliary arm forms the actual operational element which is used for cutting the material web. As already mentioned, it is not absolutely required that the cutting edge interacts with the cutting device in the manner of a shear. It is sufficient if the cutting edge tensions the material web sufficiently for enabling the cutting device to carry out an impact cut.

In accordance with another preferred feature, the auxiliary arm can be positioned in a position in which it is tangential relative to a winding sleeve onto which the material web is to be transferred. Consequently, when the cut is carried out, the free length of the material web which travels into the cutting device is very short.

Each cutting device advantageously acts simultaneously along the entire width of the material web. This produces a cut which extends essentially at a right angle relative to the travel direction. Consequently, the subsequently wound material web is uniformly wound over the entire width.

The contact pressure device preferably includes a pressure carriage which is displaceable relative to the roll carrier, wherein the carriages supporting the cutting devices are displaceable relative to the pressure carriage. A displaceable pressure carriage ensures that the diameter of the roll can increase without having to move the roll support members. The pressure carriage ensures that the contact pressure roller always can rest against the roll with the necessary pressure for achieving a predetermined pattern of the winding hardness. The cutting devices, on the other hand, are displaceable relative to the pressure carriage so that they are out of the way during winding.

Each cutting device preferably includes a guide roller which can be moved into the material web, wherein the guide roller is arranged on a carrier and a knife can be pivoted relative to the carrier. The material web which still travels onto the full roll can be guided by means of the guide roller around the empty winding sleeve, so that the remaining length which must still be guided by the knife around the winding sleeve can be kept small.

In accordance with another preferred feature, each pressure member is provided with a deflection roller which—with the intermediate arrangement of the material web—can be placed behind the cut against the new winding roller and forms a take-up nip. When the knives have cut the material web, the beginning of the material web formed by the cut is conducted practically immediately after the cut into the nip between the winding sleeve and the deflection roller and is secured at this location by the subsequently supplied material web. The material web is then held on the winding sleeve by its own tension after a few rotations, so that no additional holding means are required. Accordingly, it is then no longer required to prepare the winding sleeve, i.e., by rendering it adhesive.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
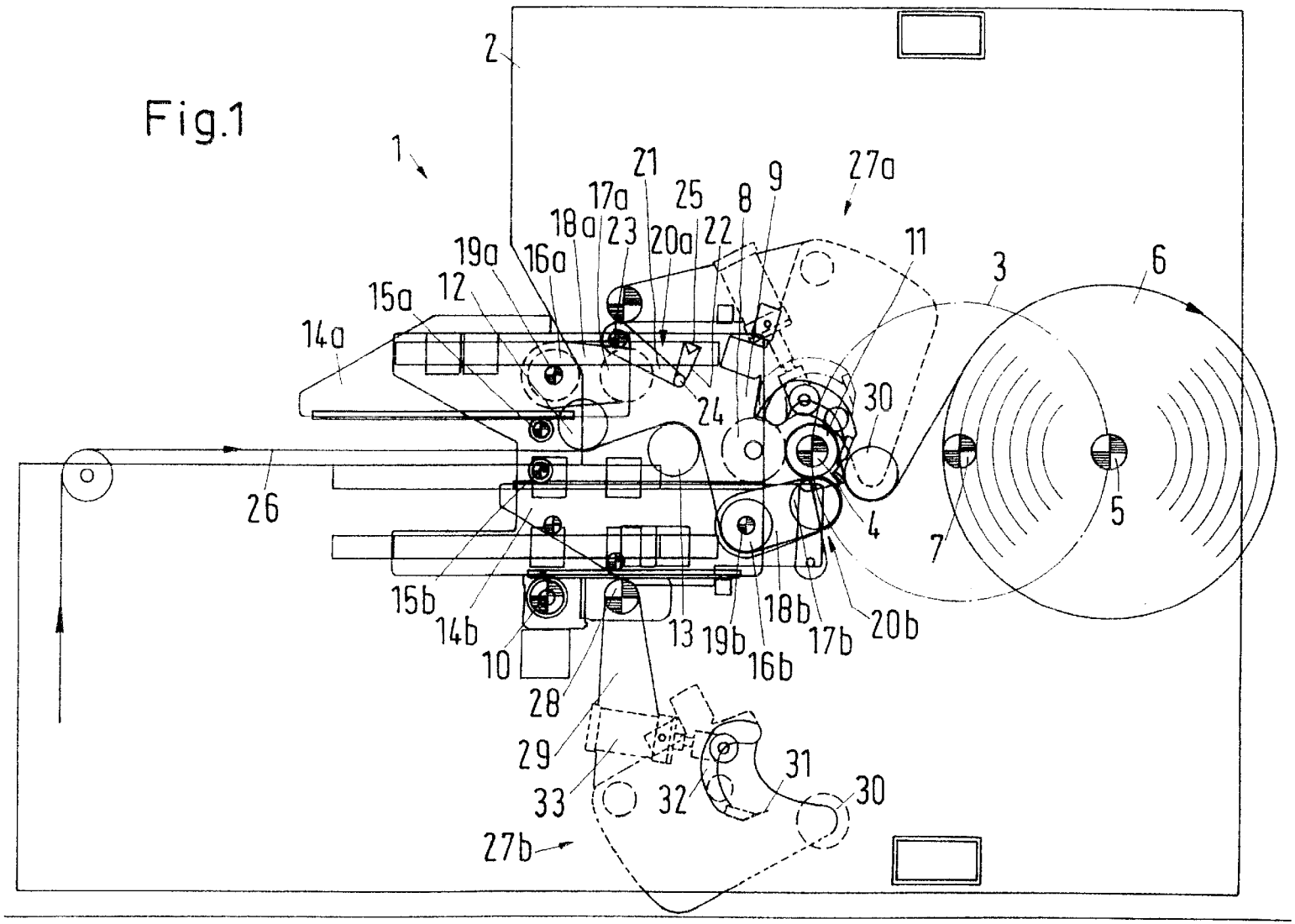
FIG. 1 is a schematic illustration of a winding device according to the present invention.

FIG. 1 shows a winding device 1 with a machine frame 2, wherein a roll carrier 3 is arranged in the machine frame 2. The roll carrier 3 is symbolically illustrated by a circle. The roll carrier 3 includes two driven roll support members 4, 5, wherein the drives of the roll support members 4, 5 can drive a roll 6 either in the clockwise direction as illustrated, or against the clockwise direction. Accordingly, the drives are reversible. The roll carrier 3 also includes a drive 7 which can move the two roll support members 4, 5 between a winding position in which the roll support member 4 is arranged as illustrated, and an exchange position in which the roll support member 5 is arranged. A relatively simple embodiment provides that the roll support members 4, 5 are arranged on arms or plates which are rotatable so that the roll support members 4, 5 carry out pivoting movements which are illustrated by a circular line of the roll carrier 3. However, it is also possible to displace the roll support members 4, 5 linearly or in a different manner.

A pressure roller 8 is arranged on a pressure carriage 9. The pressure carriage 9 is positioned by means of a drive 10 during winding always in such a way that the pressure roller 8 is pressed with a predetermined pressure against a roll or a winding sleeve 11 which is located in the roll support member 4 which is arranged in the winding position. With increasing diameter of the roll and the winding position, the carriage 9 is displaced, i.e., is moved away from the roll support member 4, so that the pressure roller 8 always can exert a uniform pressure against the roll in order to advantageously influence the winding hardness or tightness.

Two stationary deflection rollers 12, 13 are arranged on the pressure carriage 9, wherein "stationary" refers to the arrangement on the pressure carriage 9.

Two carriages 14*a* and 14*b* are additionally mounted on the pressure carriage 9, wherein the carriages 14*a*, 14*b* are displaceable relative to the pressure carriage 9 parallel to the direction in which the pressure carriage 9 can be moved away from the roll support member 4. The two carriages 14*a*, 14*b* are constructed essentially mirror-symmetrical, so that corresponding components are provided with the same reference numerals, with the letter "a" added to the components of the upper carriage and the letter "b" added to the components of the lower carriage.

Each carriage 14*a*, 14*b* includes a drive 15*a*, 15*b* for moving the carriage relative to the pressure carriage 9. Each carriage 14*a*, 14*b* additionally has a second pair of deflection rollers 16*a*, 17*a*; 16*b*, 17*b*, wherein the deflection rollers 16*a*, 17*a* and 16*b*, 17*b* are arranged on a lever 18*a*, 18*b* with a drive 19*a*, 19*b*. Each drive 19*a*, 19*b* can pivot the lever 18*a*, 18*b*.

In addition, a pressure member 20*a*, 20*b* is arranged at each carriage 14*a*, 14*b*. The following description will only refer to the pressure member 20*a*. The pressure member 20 includes a lever arm 21, wherein an auxiliary arm 22 is arranged on the lever arm 21. The lever arm 21 is pivotable relative to the carriage 14*a* by means of a drive 23. The auxiliary arm 22 can be pivoted by means of a drive 24 relative to the lever arm 21. A cutting edge 25 is arranged on the auxiliary arm 22. As illustrated in connection with pressure member 20*b*, the auxiliary arm 22 can be positioned in such a way that it is located essentially tangentially relative to the winding sleeve 11 which is arranged in the winding position 4. For this purpose, the lever arm 21 is pivoted relative to the carriage 14 and the auxiliary arm 22 is pivoted relative to the lever arm 21. Simultaneously, the lever 18 which corresponds to the pressure member 20 is pivoted in such a way that the deflection roller 17 rests against the winding sleeve 11 with the intermediate arrangement of the material web 26 which is to be wound up.

Two cutting devices 27*a*, 27*b* are arranged on the pressure carriage 9, wherein the cutting devices are also constructed in a mirror-symmetrical configuration. For reasons of clarity, only the lower cutting device 27*b* will be explained in detail. This cutting device includes a drive 28 for pivoting a lever 29 relative to the pressure carriage 9. Arranged on the lever 29 is a deflection roller 30 which can be moved into the material web in such a way that it contacts the material web 26 shortly following the winding sleeve 11. Also arranged on each cutting device 27*a*, 27*b* is a knife 31 which has a curved carrier 32. The knife is pivotable relative to the lever 29 by means of a drive 33. The knife 31 extends over the entire width of the winding device 1, so that the knife 31 is capable of cutting the material web 26 with a cut extending essentially perpendicularly of the travel direction; in other words, the knife can carry out a so-called impact cut. The carriers 32 then guide the material web around the winding sleeve 11. The cutting devices 27*a*, 27*b* form together with the pressure members 20*b*, 20*a* a transfer device on opposite sides of the material web 26.

As can be seen in FIG. 1, the material web 26 is guided at the moment of the cut over the lower deflection rollers 16*b*, 17*b* and then travels around the winding sleeve 11 in a clockwise direction. The material web is then guided over the deflection roller 30 of the upper cutting device 27*a*, while the auxiliary arm 22 of the pressure member 20*b* has been positioned relative to the material web 26 from below. However, it is not necessary in this connection that the front side of the auxiliary arm, i.e., the cutting edge 25, contacts the material web 26. An only relatively short free travel length exists between the winding sleeve 11 and the deflection roller 30. When the knife 31 is moved by the upper cutting device 27 into the material web 26, the material web 26 is cut as long as a sufficiently great tension can be maintained between the winding sleeve 11 and the deflection roller 30. In the case of material webs 26 which are more resilient, for example, certain plastic material foils, the material web is pressed against the cutting edge 25 of the pressure member 20*b* when the knife 31 is moved in. On the one hand, this further shortens the free travel length because now only one web length is available between the winding sleeve 11 and the cutting edge 25. Simultaneously, the cutting edge 25 facilitates a shearing off of the material web 26.

The curved carrier 32 now conducts the cut material web, or more precisely the beginning thereof, around the winding sleeve 11. The beginning of the web then reaches the nip between the deflection roller 17*b* and the winding sleeve 11; specifically, the beginning of the material web is conducted under the subsequently supplied material web which travels around the deflection roller 17*b*. Consequently, the material web 26 is caught and held on the winding sleeve 11 by subsequent layers of the material web.

The manner of operation of the winding device 1 will now be explained in more detail with the aid of FIGS. 2 and 3.

Figure 2A:
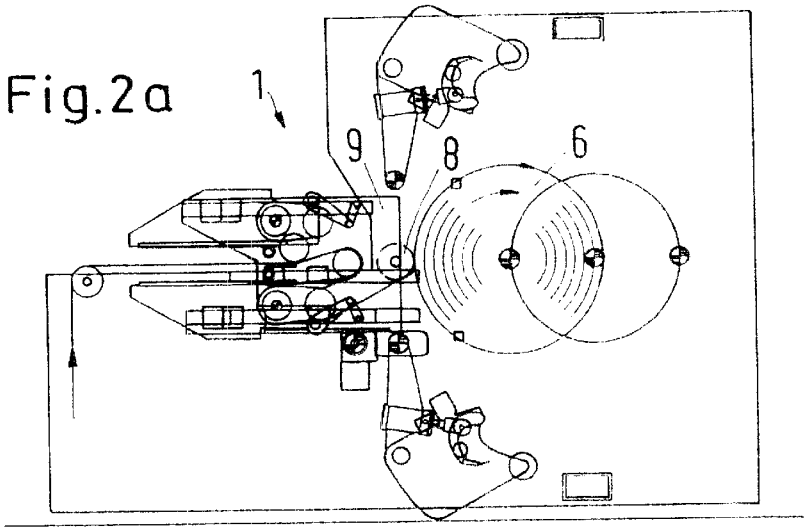
FIGS. 2*a* to 2*c* are schematic illustrations of the winding device showing different stages during winding in a clockwise direction.

FIG. 2*a* shows a state in which the roll 6 which rotates in a clockwise direction is almost completely wound up. During winding, the pressure roller 8 on the pressure carriage 9 is permanently in contact with the roll 6.

When winding of the roll 6 is finished, the pressure carriage 9 is moved back to such an extent that the pressure roller 8 loses contact with the roll 6. The roll carrier 3 is turned so that the full roll 6 is moved into the exchange position and a new winding sleeve 11 is moved into the winding position. This is effected by moving the pressure carriage 9 once again onto the winding position 4, so that the pressure roller 8 presses against the new winding sleeve 11. The roll 6 is further rotated so that the material web 26 is further wound up during this step.

Subsequently, the lower carriage 14*b* moves towards the winding sleeve 11 until it comes into contact with a stop 34. Simultaneously with this movement or slightly later, the pressure member 20*b* is pivoted into a position as illustrated in FIG. 1. The lever 18*b* is pivoted upwardly so that the deflection roller 17*b* comes into contact with the winding sleeve 11. Now the situation has been reached which is illustrated in FIG. 1. The cutting procedure described above can now be carried out.

Figure 2B:
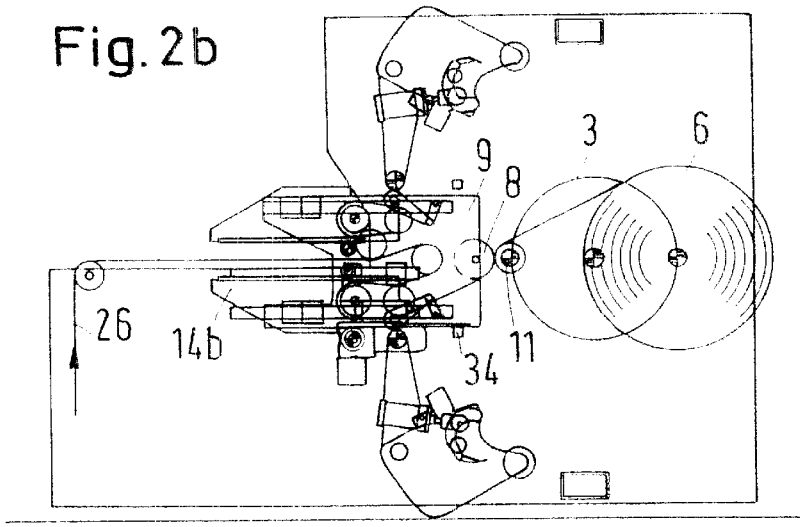
Figure 2C:
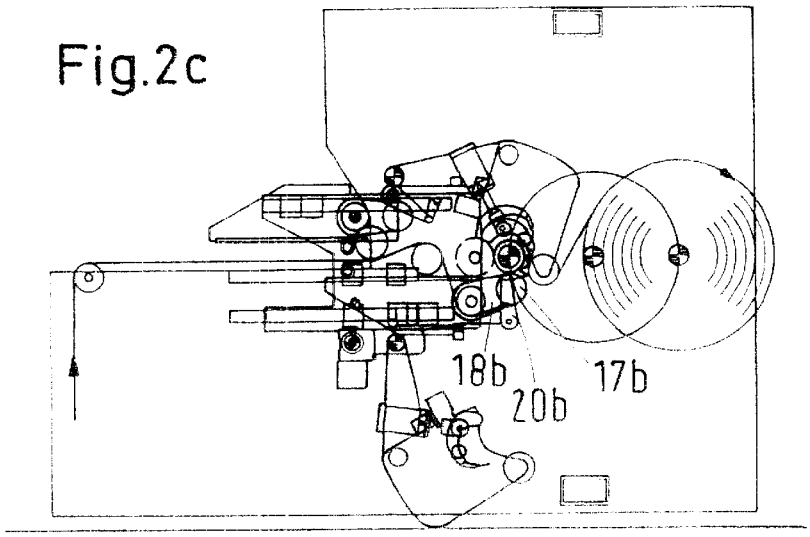

FIG. 2 shows that the material web 26 has been guided through the winding device 1 along a first material web path. This first material web path includes contact with the deflection roller 12, partial travel around the deflection roller 13 and travel around the deflection rollers 16*b*, 17*b*. The material web then reaches the pressure roller 8 from below.

Figure 3A:
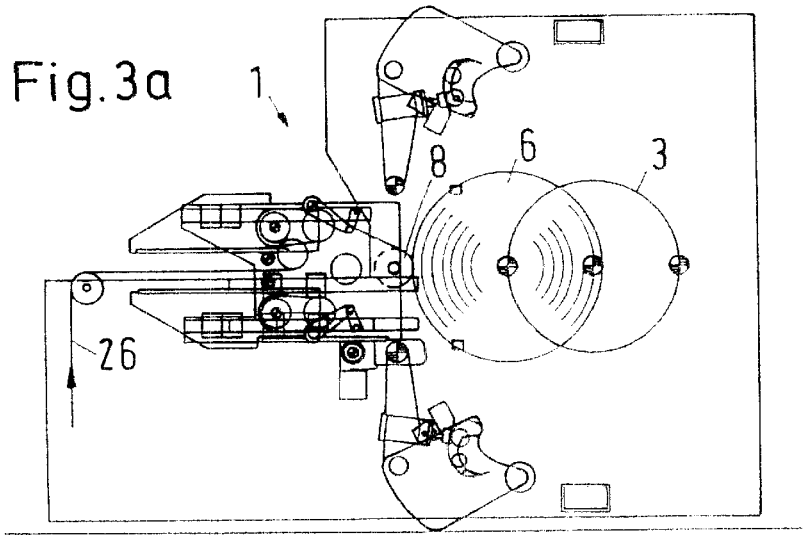
FIGS. 3*a* to 3*c* are schematic illustrations of the winding device showing different stages during winding in a counterclockwise direction.
Figure 3B:
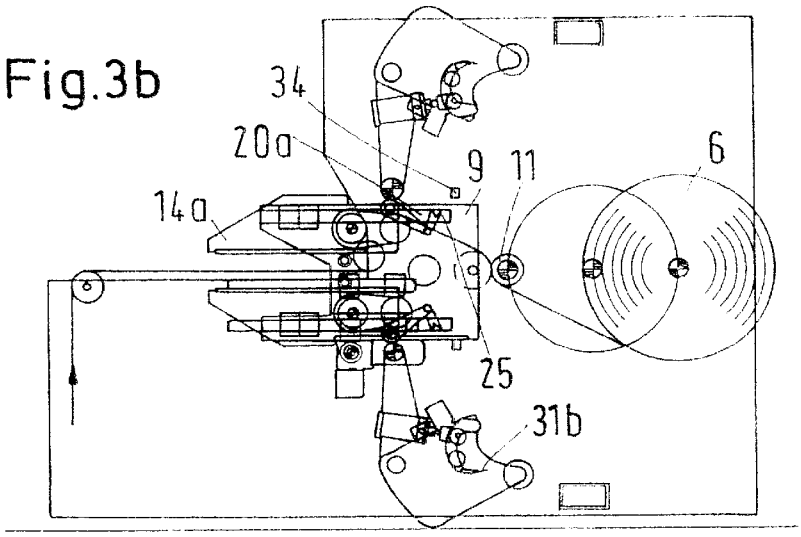
Figure 3C:
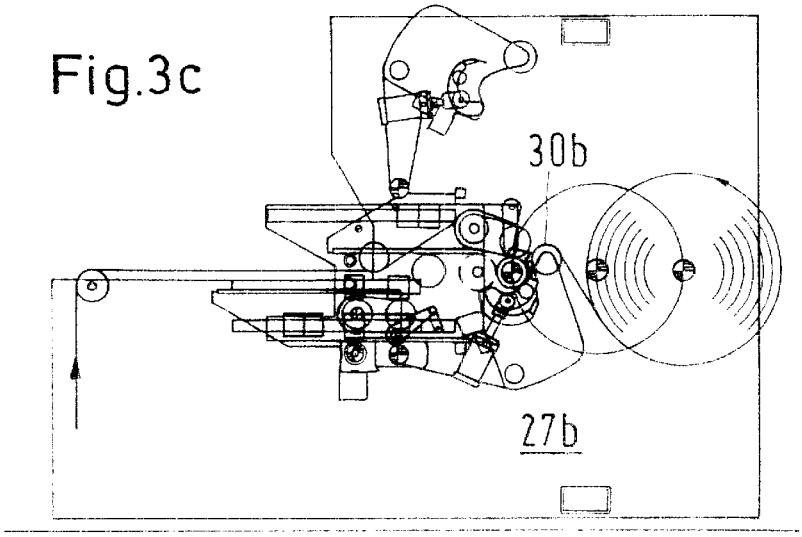

FIG. 3 now shows the manner of operation of the winding device 1 in which the roll 6 is rotated in the opposite direction. A corresponding second material web path is provided for the material web 26, wherein the material web travels around the deflection roller 12. The material web is then guided around the deflection roller 17*a* and reaches the pressure roller 8 from above.

The exchange of rolls takes place in a similar manner as described in connection with FIG. 2. When the roller 6 is full, the roll carrier 3 is turned so that a winding sleeve 11 is moved into the winding position, while the roll 6 is then located in the exchange position. When the roll carrier 3 is moved, the pressure carriage 9 is advantageously moved towards the left as seen in the drawing, so that pressure roller 8 looses contact with the roll 6.

For effecting the transfer, the upper carriage 14*a* is moved against the stop 24 and the pressure member 20*a* is pivoted against the clockwise direction, so that the auxiliary arm 22 extends tangentially relative to the winding sleeve 11. When the cutting device 27*b* now is moved with its deflection roller 30*b* into the material web 26, the knife 31*b* can cut the material web 26 along the short distance between the winding sleeve 11 and the deflection roller 30*b,* wherein advantageously the cutting edge 25 of the pressure member 20*a* is additionally utilized.

The embodiment illustrated in the drawing can be modified in many ways.

Many linear movements can be replaced by pivoting movements. The yielding movements of the pressure member 20 relative to the cutting device 27 on the other side of the material web 26 can also be realized in different ways. However, it is advantageous if the pressure member is moved away from the roll 6, so that the movement of the other cutting device 27 is not impaired.

While specific embodiments of the invention have been shown and described in detail to illustrate the inventive principles, it will be understood that the invention may be embodied otherwise without departing from such principles.

We claim:

1. A winding device for winding a material web into a roll, the winding device comprising a roll carrier with at least two driven roll support members, wherein the two driven roll support members are each mounted so as to be movable between a winding position and an exchange position, a contact pressure device for exerting a pressure on the roll, means for driving the roll support members in two different directions of rotation, a first material web path at an end of which the material web travels in a first direction onto the roll, and a second material web path at an end of which the material web travels in a second direction onto the roll, further comprising a transfer device with a first cutting device mounted so as to be movable from a first side into the material web and with a second cutting device mounted so as to be movable from a second side into the material web, wherein each cutting device comprises a counter pressure member arranged on an oppositely located side of the material web.

2. The winding device according to claim 1, wherein each cutting device is configured to act simultaneously over an entire width of the material web.

3. The winding device according to claim 1, wherein the first and the second cutting devices are mounted so as to be mirror-symmetrical relative to each other.

4. A winding device for winding a material web into a roll, the winding device comprising a roll carrier with at least two driven roll support members, wherein the two driven roll support members are each mounted so as to be movable between a winding position and an exchange position, a contact pressure device for exerting a pressure on the roll, means for driving the roll support members in two different directions of rotation, a first material web oath at an end of which the material web travels in a first direction onto the roll, and a second material web path at an end of which the material web travels in a second direction onto the roll, further comprising a transfer device with a first cutting device mounted so as to be movable from a first side into the material web and with a second cutting device mounted so as to be movable from a second side into the material web, wherein each cutting device comprises a counter pressure member arranged on an oppositely located side of the material web, wherein each counter pressure member of a cutting device is mounted on the carriage, wherein the carriage is mounted so as to be displaceable relative to a knife unit of another of the cutting devices.

5. The winding device according to claim 4, wherein each counter pressure member comprises a lever arm mounted on the carriage so as to be pivotable.

6. The winding device according to claim 5, wherein an auxiliary arm is mounted on each lever arm, wherein the auxiliary arm is pivotable in a controlled manner relative to the lever arm, and wherein the auxiliary arm includes a cutting edge.

7. The winding device according to claim 6, wherein the lever arm is configured to be positionable in a tangential position relative to a winding sleeve onto which the material web is to be wound.

8. The winding device according to claim 4, wherein the contact pressure device comprises a pressure carriage, wherein the pressure carriage is mounted so as to be displaceable relative to the roll carrier, and wherein the carriages of the cutting devices are mounted so as to be displaceable relative to the pressure carriage.

9. A winding device for winding a material web into a roll, the winding device comprising a roll carrier with at least two driven roll support members, wherein the two driven roll support members are each mounted so as to be movable between a winding position and an exchange position, a contact pressure device for exerting a pressure on the roll, means for driving the roll support members in two different directions of rotation, a first material web path at an end of which the material web travels in a first direction onto the roll, and a second material web path at an end of which the material web travels in a second direction onto the roll, further comprising a transfer device with a first cutting device mounted so as to be movable from a first side into the material web and with a second cutting device mounted so as to be movable from a second side into the material web, wherein each cutting device comprises a guide roller mounted so as to be movable into the material web, wherein each guide roller is mounted on a carrier, and wherein a knife is provided so as to be pivotable relative to the carrier.

10. A winding device for winding a material web into a roll, the winding device comprising a roll carrier with at least two driven roll support members, wherein the two driven roll support members are each mounted so as to be movable between a winding position and an exchange position, a contact pressure device for exerting a pressure on the roll, means for driving the roll support members in two different directions of rotation, a first material web path at an end of which the material web travels in a first direction onto the roll, and a second material web path at an end of which the material web travels in a second direction onto the roll, further comprising a transfer device with a first cutting device mounted so as to be movable from a first side into the material web and with a second cutting device mounted so as to be movable from a second side into the material web, wherein each cutting device comprises a counter pressure member arranged on an oppositely located side of the material web, wherein a deflection roller is provided for each counter pressure member, wherein each deflection roller is configured to be placeable with an intermediate arrangement of the material web following a cut point of the material web against a new winding sleeve and to form a catching nip.

* * * * *